US005947584A

United States Patent [19]

Passanante et al.

[11] Patent Number: 5,947,584

[45] Date of Patent: Sep. 7, 1999

[54] ILLUMINATED TRASH RECEPTACLE

[76] Inventors: Caesar A. Passanante, 19 Rte. 121, Brewster, N.Y. 10509; Stephen J. Smith, 40 Gateway Rd., Apt. 111N, Yonkers, N.Y. 10703

[21] Appl. No.: 08/820,966

[22] Filed: Mar. 19, 1997

[51] Int. Cl.[6] ..... F21V 33/00

[52] U.S. Cl. ..... 362/154; 362/84; 362/183; 362/234; 362/812

[58] Field of Search ..... 40/567; 362/84, 362/183, 154, 812, 234, 253

[56] References Cited

U.S. PATENT DOCUMENTS

| | | | |
|---|---|---|---|
| 757,403 | 4/1904 | Leveen | 40/567 |
| 1,569,706 | 1/1926 | Bulwinkle | 40/567 |
| 1,645,870 | 10/1927 | Overton et al. | 40/567 |
| 1,816,974 | 8/1931 | Kavanagh | 40/567 |
| 1,837,447 | 12/1931 | Kenny | 40/567 |
| 2,543,008 | 2/1951 | French | 40/567 |
| 3,947,985 | 4/1976 | Skrzypczak | 40/33 |
| 4,534,743 | 8/1985 | D'Onofrio et al. | 445/24 |
| 4,751,615 | 6/1988 | Abrams | 362/31 |
| 4,827,645 | 5/1989 | Stamps, Jr. | 40/567 |
| 5,019,748 | 5/1991 | Appelberg | 315/169.3 |
| 5,045,755 | 9/1991 | Appelberg | 313/498 |

OTHER PUBLICATIONS

E–Lite, Technology Website (Tab A), no publication date given.

*Primary Examiner*—Stephen Husar
*Attorney, Agent, or Firm*—Sixbey, Friedman, Leedom & Ferguson, P.C.

[57] ABSTRACT

An illuminated trash receptacle having lighting devices that provide uniform illumination of an advertisement displayed on the side walls of the receptacle without occupying much more space within the side walls of the receptacle than the advertisement. The lighting device has a light emitting surface having a surface area corresponding to the advertising area of the advertisement. Preferably, the light emitting surface contacts the advertisement. The lighting device may be an electroluminescent flat lamp, or a substantially planar light guide that emits light over the entire surface area of the visible portion of the advertisement.

18 Claims, 5 Drawing Sheets

ILLUMINATED TRASH RECEPTACLE

BACKGROUND OF THE INVENTION

The present invention relates to trash receptacles having illuminated advertising panels. In particular, the present invention relates to the provision of a uniformly illuminated advertising panel for a trash receptacle that requires less power than prior art illuminated trash receptacles, simpler installation of the lighting devices, and a more compact panel design.

Trash receptacles having advertising panels have been known in the art. Additionally, with the advent of low energy light sources, illumination of such advertising panels has also become known in the art. Until now, light bulbs have been used to illuminate the panels. For example, U.S. Pat. No. 757,403 to Leveen shows a waste paper box having sides formed from transparent slides with advertising matter painted thereon. Electrical illuminating devices, such as incandescent bulbs, are provided in a space behind the slides and an inner box (in which the waste is collected). With the popularity of solar power, it has become known to power the light bulbs of illuminated trash receptacles with solar cells and electrical storage batteries, as described in U.S. Pat. No. 4,827,643 to Stamps, Jr.

However, the lighting devices used to illuminate prior art trash receptacles cannot uniformly illuminate an advertising panel because known light bulbs are of a set size and shape that does not closely correspond to the size and shape of standard advertising panels. The size of the light bulb behind the advertising panel is generally smaller than the surface area of the advertising panel. Thus, the portion of the advertising panel behind which the light bulb is positioned is generally more brightly illuminated than the other portions of the panel.

Moreover, because of the typical shape of currently available light bulbs, a compartment that is several times the thickness of the advertising panel itself must be provided to accommodate the desired lighting device that illuminates the advertising panel. Because the light bulbs that have been used in prior art illuminated trash receptacles also generate a significant amount of heat which may damage the advertising panel, sufficient space must be provided not only to accommodate the light bulb itself, but also to provide sufficient spacing between the light bulb and the advertising panel to protect the panel from damage from the bulb.

Another drawback of the use of common lighting devices used in the prior art is that the devices burn out and must be regularly replaced. Generally, incandescent light bulbs are screwed into a socket. Thus, sufficient access to the interior space in which the lighting mechanism is housed must be provided to unscrew the burnt out bulb and replace it with a new one. Flourescent light bulbs, although lasting longer than incandescent bulbs, do burn out and must also be replaced. This requires precise alignment of the fluorescent bulb in its respective socket for a proper fit. Thus, flourescent bulbs also require sufficient access space for replacement so that proper alignment of the bulb and the connection socket may be achieved without also covering the bulb (to support the bulb and provide a guide for the bulb to approach the socket, while also interfering with light transmission to the advertising panel).

A related drawback is the sensitivity of the lighting devices that have been used in prior art illuminated trash receptacles. Incandescent bulbs have filaments that not only wear out but also break if subjected to sufficient impact or vibrations. Flourescent bulbs are subject to malfunction in certain environments. Thus, under certain weather conditions, such as extremely low temperatures, the gases within the flourescent bulbs do not function properly, causing the bulb to flicker, thereby interfering with uniform illumination of the advertising panel.

SUMMARY OF THE INVENTION

It is therefore an object of the present invention to provide a trash receptacle having uniformly illuminated advertising panels, the lighting mechanism uniformly shining light on the advertising panel.

It is another object of the present invention to provide a lighting mechanism for an illuminated trash receptacle that does not require significantly more space than the advertising panel itself because of the size of the lighting mechanism.

It is a related object of the present invention to provide a lighting mechanism for an illuminated trash receptacle that does not require significantly more space than the advertising panel itself because the lighting mechanism does not require ready accessibility for replacement of the lighting device.

It is yet another object of the present invention to provide a long-lasting lighting mechanism for illuminating advertising panels on a trash receptacle, the light source being relatively insensitive to environmental conditions such as impact, vibrations, punctures, and temperature changes.

It is a further object of the present invention to provide a lighting mechanism for illuminating advertising panels on a trash receptacle, the lighting mechanism being simple to replace and not requiring additional space to do so.

These and other objects of the present invention are accomplished in accordance with the principles of the present invention by providing a trash receptacle having advertising panels that are illuminated by substantially flat lighting devices that are dimensioned to correspond to the dimensions of the advertising panels. For example, a substantially flat electroluminescent panel lamp that may slidably engage an electrical connector that provides power to the lamp may be provided in a relatively narrow space behind an advertising panel to illuminate the panel. The lamp may be either a split-electrode or parallel plate type lamp. Alternatively, a substantially flat light guide may be provided over the external face of the advertising surface to uniformly spread and reflect light over the external face. The light guide may comprise a flat sheet of acrylic dimensioned to substantially conform to the surface area of the advertising panel and cut such that light passed through an end surface perpendicular to the advertising face exits the acrylic sheet perpendicular to the advertising face to thereby hit and reflect off of the advertising face.

BRIEF DESCRIPTION OF THE DRAWINGS

These and other features and advantages of the present invention will be readily apparent from the following detailed description of the invention, the scope of the invention being set out in the appended claims. The detailed description will be better understood in conjunction with the accompanying drawings, wherein like reference characters represent like elements, as follows:

DETAILED DESCRIPTION OF THE INVENTION

Figure 1:
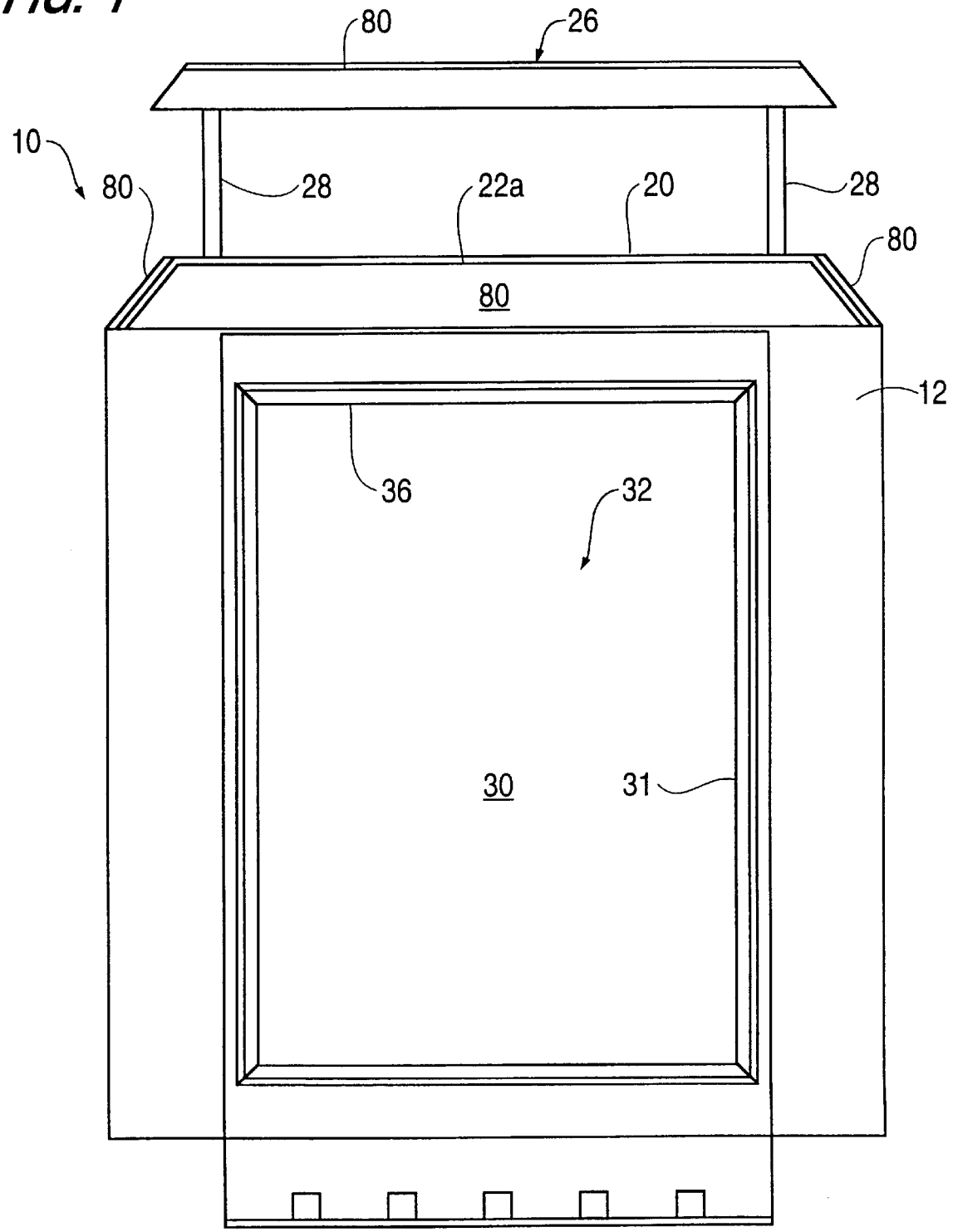
FIG. 1 is an elevational view of an illuminated trash receptacle formed in accordance with the principles of the present invention.

An illuminated trash receptacle 10 formed in accordance with the principles of the present invention is shown in FIG. 1. Receptacle 10 is formed from a frame 12, preferably formed from stainless steel or another similarly sturdy rust-resistant material, having a substantially square cross-section, as may be seen in FIG. 2, defining an interior space 13 therein. As may be seen in FIG. 2, frame 12 includes four side walls 14 separated by side posts 16. However, it will be appreciated that fewer or greater than four side walls may be provided instead. For example, a trash receptacle having a substantially circular cross-section with a curved side wall may be provided. If side posts 16 are provided, they may be shaped with rounded edges, or otherwise shaped for not only aesthetic appeal, but also for safety (by avoiding the presence of sharp edges).

Figure 2:
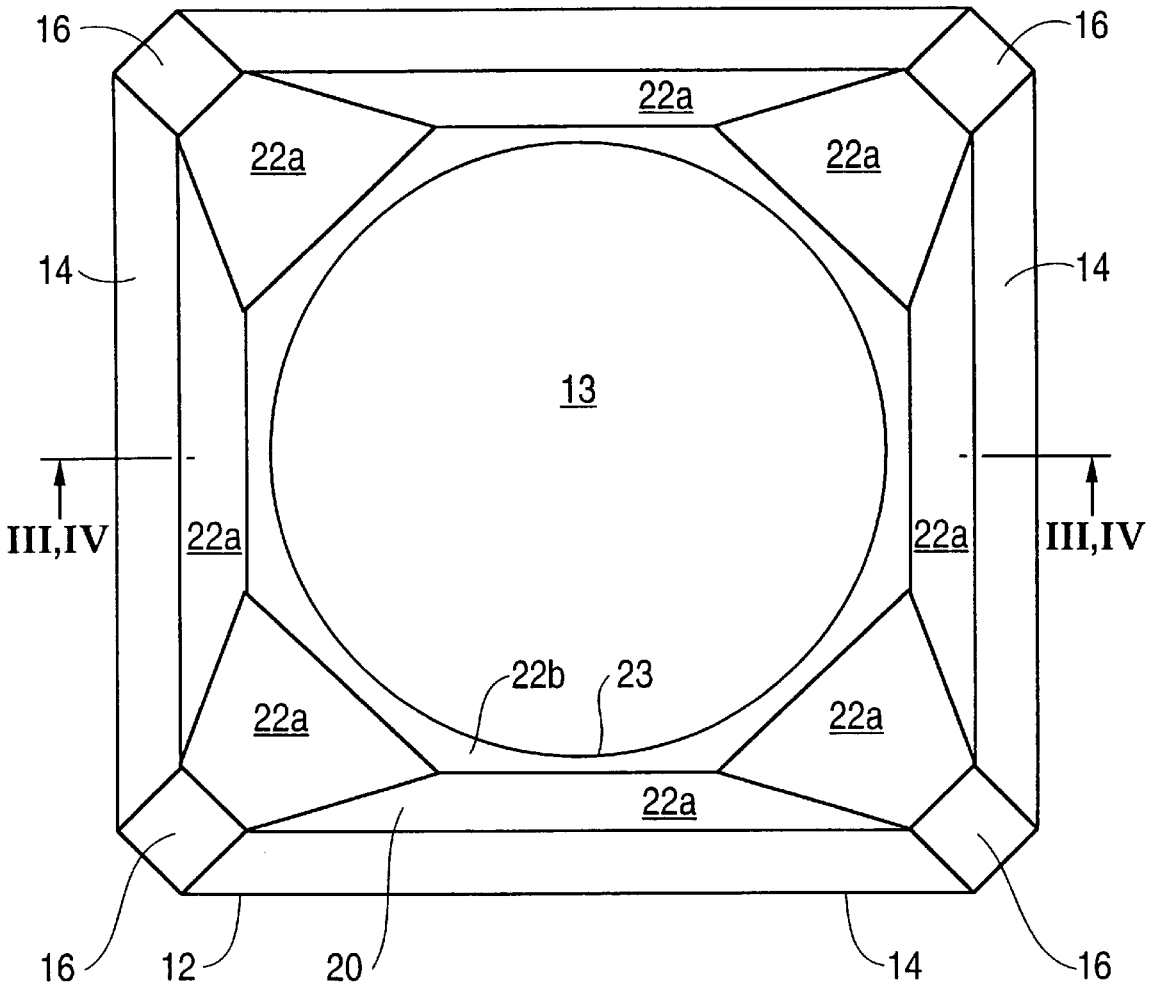
FIG. 2 is a top, plan view of the trash receptacle of FIG. 1.
Figure 3:
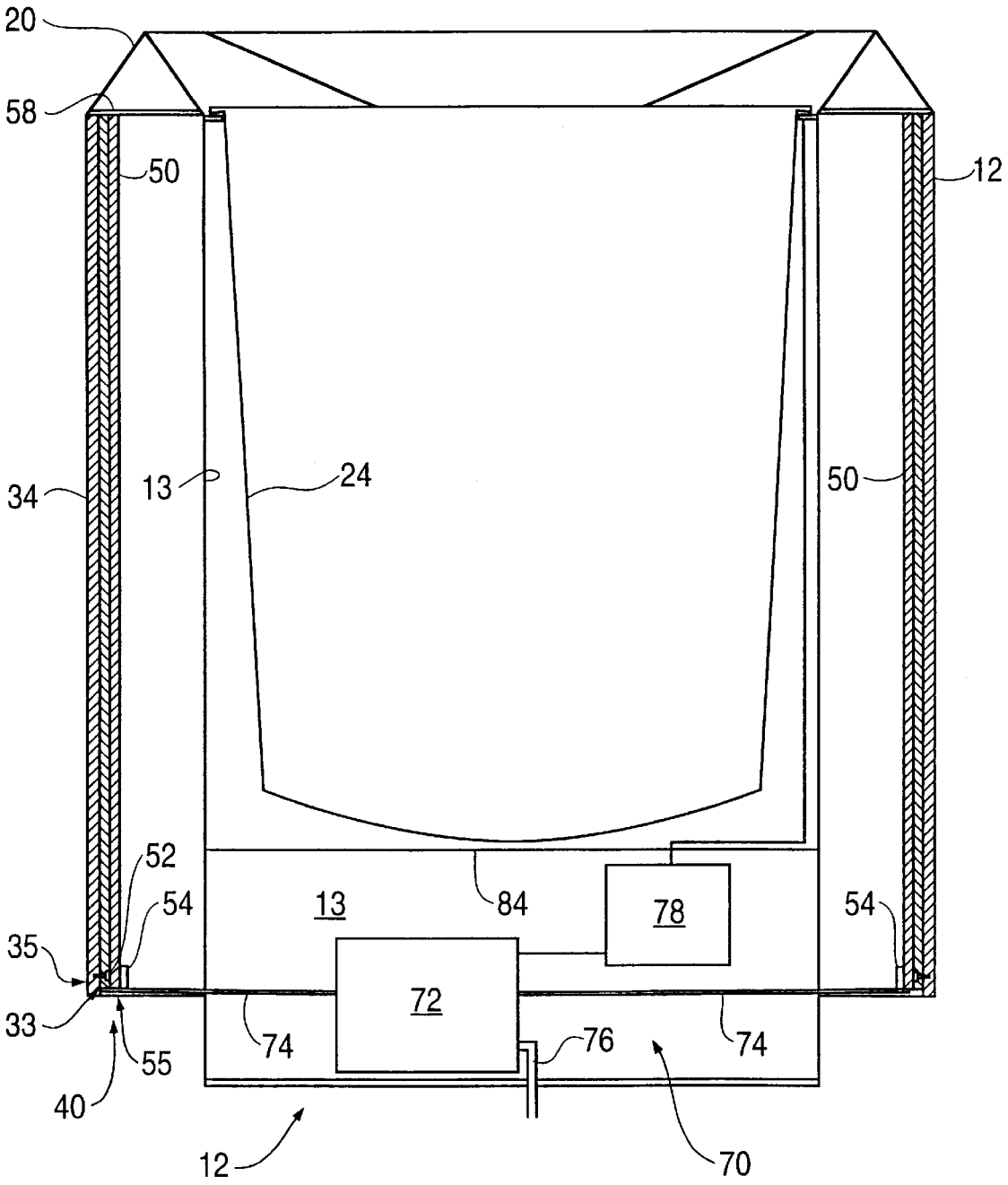
FIG. 3 is a cross-sectional view along line III—III of FIG. 2 showing a first illuminating device for illuminating the advertising panels of the trash receptacle of the present invention.
Figure 4:
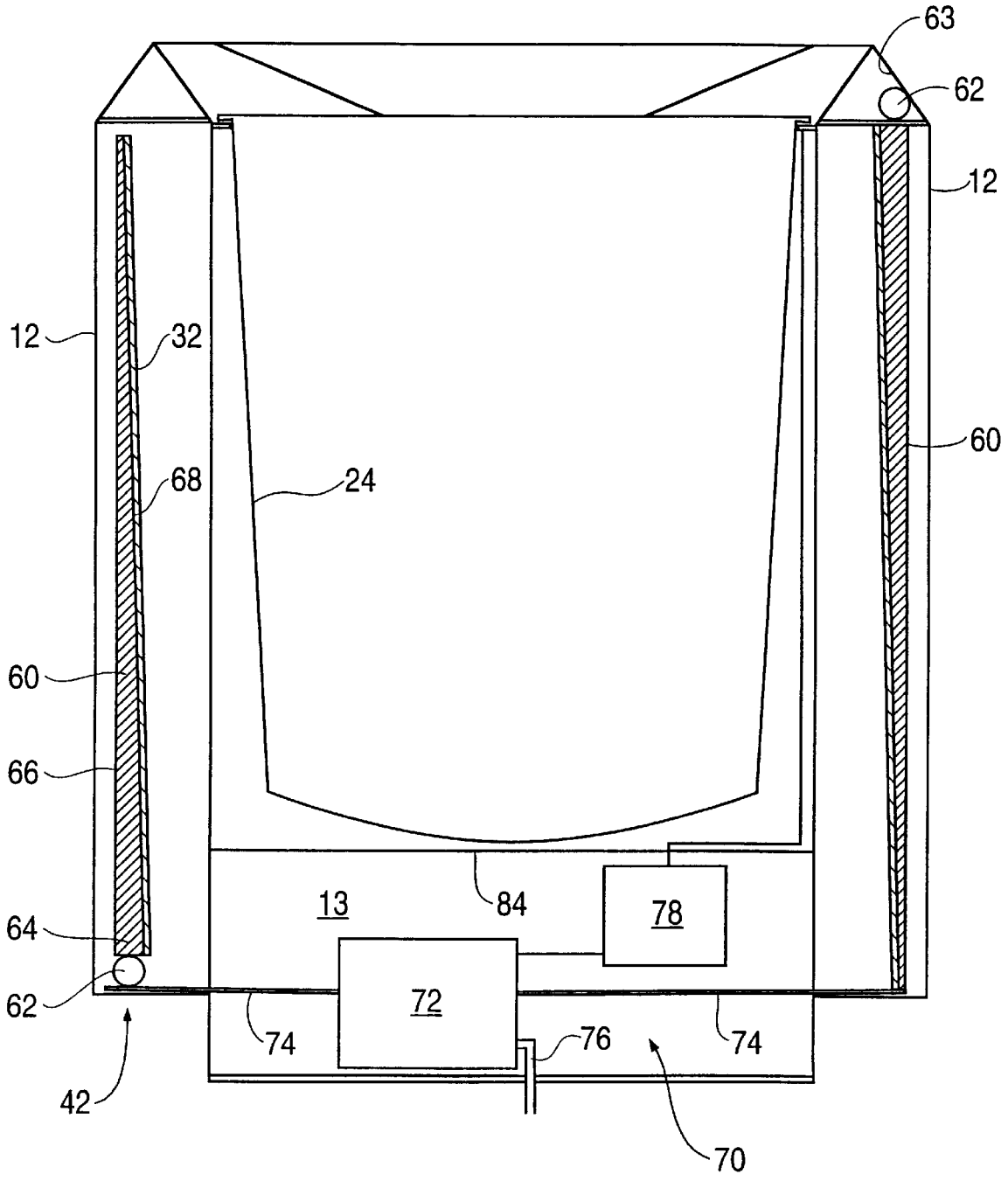
FIG. 4 is a cross-sectional view along line IV—IV of FIG. 2 showing a second illuminating device for illuminating the advertising panels of the trash receptacle of the present invention.

Trash receptacle 10 preferably also has a top wall 20 that may be decoratively formed as well. As shown in FIG. 2, top wall 20 has multiple panels 22 lying in a plane, which panels are at angles with respect to each other to enhance the aesthetic appeal of the receptacle 10. Peripheral panels 22*a* may, for example, be transverse, but not perpendicular, to side walls 14, whereas central top panel 22*b* may be perpendicular to side walls 14. Aperture 23 is provided in central top panel 22*b* to provide access to inner receptacle 24 (FIGS. 3 and 4). Inner receptacle 24 is provided to hold trash placed in receptacle 10 and to protect the inner surface 15 of frame 12 from becoming soiled from the deposit of trash therein. Awning 26 (FIG. 1) may be provided over aperture 23 to prevent rain or other matter from accidentally entering inner receptacle 24. Awning 26 is spaced above top wall 20 by posts 28 a sufficient distance to permit ready access to opening 23 preventing large pieces of household trash or large boxes from being deposited through opening 23.

As may be seen in FIG. 1, at least one of side walls 14 has an advertising panel 30 having a length and width defining a viewing area 31 through which an advertisement 32 is displayed and viewed. Advertisement 32 is positioned in a recess 33 formed within side wall 14, as may be more clearly seen in FIG. 3. The requisite forces for maintaining an advertisement in place within recess 33 of advertising panel 30 are provided by any desired force applying mechanism known in the art. In the preferred embodiment, a recess or frame shaped to accommodate and securely engage advertisement 32 is provided.

In order to protect advertisement 32, a clear protective panel 34 may be provided in recess 35 in side wall 14. Preferably, clear protective panel 34 is formed from a tough, non-breakable, shatter-proof material, such as a clear plastic material. Most preferably, clear protective panel 34 is also a water-proof, scratch-resistant, graffiti-proof, and bullet-proof material. A preferred material from which protective panel 34 is made is a bullet-proof polycarbonate sheet material sold under the trademark LEXAN® by General Electric Plastics Structured Products Department of General Electric Company of Pittsfield, Mass. A separate graffiti-proof material or coating may be applied to clear protective panel 34. In a preferred embodiment, a graffiti-proof and bullet-proof material sold under the trademark LEXAN MR5® by the aforementioned General Electric Plastics Structured Products Department. This material is a sheet of LEXAN® covered with a graffiti-proof coating which, when sold separately, is sold under the trademark MARGUARD® by the aforementioned General Electric Plastics Structured Products Department.

A decorative framing element 36 may be provided to encircle advertisement 32 in an aesthetic manner. The material from which advertisement 32 is formed is selected according to the lighting mechanism provided to illuminate advertisement 32, as will now be described.

In accordance with the principles of the present invention, a lighting device 40, 42 is provided which uniformly illuminates advertisement 32 while requiring a smaller housing and lower power requirement than prior art illuminated trash receptacles. Additionally, lighting device 40, 42 has a thickness (the dimension perpendicular to the planar viewing surface along side wall 14) that is not much greater than the thickness of advertisement 32. In particular, the space required to accommodate the thickness of lighting device 40, 42 is less than one (1) centimeter in depth, and may be as thin as 10 mils. Thus, the space accommodating lighting device 40, 42 is preferably substantially equivalent to the space required to accommodate the advertisement 32.

In the embodiment of FIG. 3, illuminating device 40 is in the form of an electroluminescent flat panel lamp 50. Lamp 50 may be a split-electrode or parallel plate type lamp, such as described, for example, in any of U.S. Patents U.S. Pat. No. 4,534,743 to D'Onofrio et al., U.S. Pat. No. 5,019,748 to Appelberg, and U.S. Pat. No. 5,045,755 to Appelberg, which patents are hereby incorporated herein by referenced in their entirety. In either case, lamp 50 has a light emitting surface in the form of a substantially flat panel.

As described in the aforementioned patents incorporated herein, lamp 50 comprises an electroluminescent layer, preferably formed from a thin layer of phosphor, and conductive material for establishing a voltage across the electroluminescent layer to cause it to luminesce. An integral connector 52 for electrically coupling or engaging with an electrical connector 54 is provided along an edge of lamp 50. The integral connector is preferably in the form of a tab including first and second conductive layers with the electroluminescent layer positioned therebetween, thus spacing the conductive layers apart. The electrical connector 54 provides the desired voltage across the conductive layers to cause the electroluminescent layer to luminesce and thereby illuminate the lamp. Because the phosphor layer of lamp 50 is uniformly spread over the conductive layers which comprise the lamp, illumination is uniformly provided over the entire light emitting area of lamp 50.

Such electroluminescent lamps are more efficient at converting energy to illumination as opposed to heat (such as produced by incandescent bulbs). Thus, the power requirements for such electroluminescent lamps are typically substantially lower than that of prior art light bulbs for a given amount of illumination. An 11.25 watt electroluminescent flat lamp, sold under the trademark FLATLITE® by E-Lite Technologies, Inc. of Stratford, Conn., is preferably used, thus providing a total of 45 watts of illumination to a receptacle 10 having four illuminated side walls 14. The 11.25 watt FLATLITE® electroluminescent flat lamp requires 250–280 volts of AC power and provides a brightness of 16 foot lamberts. Such lamps do not burn out, but merely dim after extended use (for example, the lamp will dim after one year of continuous use). Moreover, the power supply can be adjusted to give varying levels of brightness to suit any specific application. Because lamps 50 are low energy lamps, they may be placed immediately against advertisement 32 without risk of burning the material from which advertisement 32 is formed. Lamp 50 typically back lights advertisement 32. Thus, advertisement 32 must be formed from a transparent or translucent material through which light emitted by lamp 50 passes to illuminate advertising matter on advertisement 32. Also, lamp 50 is positioned on one side (the back side, closer to interior space 13 of receptacle 10) of advertisement 32 and advertising matter on advertisement 32 is visible from the otherside (the outer side, facing observers). A preferred material from which advertisement 32 is formed is a transparency sold under the trademark DURATRANS® by Eastman Kodak Company of Rochester, N.Y.

The length and width of lamp 50 are selectable to correspond to the desired area to be illuminated such that lamp 50 has a light emitting surface corresponding to the advertising surface (the surface area of advertisement 32 visible through viewing area 31 of advertising panel 30) to be illuminated. Because of the manner in which lamp 50 is formed, lamp 50 may be cut to a desired shape without interfering with the functional capabilities of lamp 50. It is noted that in addition to being able to withstand cuts and tears, lamp 50 may also be punctured without any reduction in lighting capacity, and is not functionally impaired by temperature changes. Thus, a flexible, relatively indestructible lighting device may be provided which corresponds to the length and width of the advertising panel 30 through which advertisement 32 is viewed and illuminated by lamp 50. Thus, the advertising area of advertisement 32 (the surface area of advertisement 32 that is visible through advertising panel 30) is uniformly lit by lamp 50. Moreover, such electroluminescent flat panel lamps as lamp 50 may be formed to have a thickness of less than one millimeter, and, even less than one-half (½) of one millimeter. Most typically, the lamp used in the present invention is not more than approximately 10–15 mils thick—the lamp itself being approximately 10 mils thick with a protected sheathing adding another 10 mils of thickness thereto. Thus, lamp 50 has a thickness less than that of a business card, and typically on the same order of thickness as the advertisement 32.

Each side wall 14 of receptacle 10 thus is preferably provided with a lamp 50 and an electrical connector 54 through which lamp 50 is powered. Integral connector 52 of lamp 50 is sufficiently rigid that lamp 50 may be slid into a recess 55 in side wall 14 from upper end opening 58 in side wall 14 and still make electrical contact with connector 54. Electrical connector 54 preferably is an electrical harness supplied by E-Lite Technologies, Inc., the same supplier of the electroluminescent lamp 50. Because, as described above, lamp 50 is very thin, recess 55 need not be much wider than recesses 33 and 35 for advertisement 32 and clear protective panel 34, respectively. Thus, the space required for housing lamp 50 is substantially equal to the space required to house advertisement 32. Also, because integral connector 52 may be slid into electrical connector 54 to achieve the necessary friction fit between integral connector 52 and electrical connector 54, ready access to electrical connector 54 is not necessary as in prior art illuminated receptacles. Lamp 50 may be lifted from within recess 55 through upper end opening 58 and, if necessary, replaced with another lamp 50, which is slid down into recess 55 through upper end opening 58. Thus, replacement of lamps 50 merely requires a small, thin access area along the top of side wall 14, which may be achieved by lifting top wall 20 which normally covers upper end opening 58 of side wall 14. Only when repair or replacement of electrical connector 54, or other repair of other interior portions of side wall 14 are necessary, is greater access required. Such access may be achieved by disassembling side wall 14.

Uniform illumination of advertisement 32 may also be achieved by using a lighting device 42 comprising a planar light guide 60 in the form of a substantially flat panel and a light source 62 positioned at one end thereof, as shown in FIG. 4. Light guide 60 is formed from a clear material that uniformly transmits light along a substantially straight path without dispersing or attenuating the light transmission. A preferred material is an acrylic such as LUCITE®, sold by Commercial Plastics Inc. As may be seen in FIG. 4, light guide 60 has a thick light-receiving end 64, a display side 66 that is substantially perpendicular to light-receiving end 64 (and facing the observer), and an angled light-transmitting side 68 at an acute angle with respect to light-receiving end 64 (and facing advertisement 32 and thus interior space 13 within receptacle 10). A light source 62 is positioned adjacent light-receiving end 64. Any desired light source 62 may be used with lighting device 42. Most typically, a low temperature, high intensity elongated 10 watt flourescent bulb (in the form of a straight mini-tube) is used. As may be seen in FIG. 4, light source 62 either may be positioned at the bottom of light guide 60 and thus at the bottom of side wall 14, or at the top of light guide 60 and preferably within a recess 63 provided in top wall 20.

Because light source 62 is at an end of light guide 60, light source 62 also is at an end of advertisement 32 and does not touch advertisement 32. Only light guide 60, specifically light-transmitting side 68, touches advertisement 32, if at all. Thus, lighting device 42 may be positioned immediately against advertisement 32 without the danger of overheating or burning advertisement 32.

Light emitted from light source 62 is transmitted through the body of light guide 60 and exits through light-transmitting side 68. Thus, light-transmitting side 68 may be considered the light emitting surface of lighting device 42. Because light is not distorted by light guide 60, light passing through light-receiving end 62 comes substantially straight out of light-emitting side 68. Advertisement 32 is positioned adjacent, and preferably abutting, light-emitting side 68 so that the light exiting light-emitting side 68 impinges on and is reflected off of advertisement 32, thereby illuminating advertisement 32. Thus, advertisement 32 preferably is formed as an opaque sheet positioned behind lighting device 42, as may be seen in FIG. 4.

Light guide 60 may have any desired length and width, preferably corresponding to the length and width of the advertising area of advertisement 32 (i.e., the surface of advertisement 32 visible through viewing area 31 of advertising panel 30). Thus, light from light source 62 exiting light-emitting side 68 of light guide 60 is provided over the entire advertising area of advertisement 32 to substantially uniformly illuminate advertisement 32. Because light guide 60 merely transmits light, it need only be sufficiently thick enough to provide the required incline from light-receiving end 66 to the opposite end of light guide 60. Typically the thickest end of light guide 60 is not more than ¾ in. (19 mm) at its thickest end and tapers to a point at its thinnest end. Thus, the central portion of light guide 60 (i.e., half way between the thickest end and the thinnest end) has a thickness of preferably less than one (1) cm.

The necessary power equipment 70 for lighting devices 40 and 42 is provided by control box 72 via power lines 74. Control box 72 contains the necessary control circuits and timers for illuminating trash receptacle 10 at the desired times. Additionally, control box 72 steps up the power supplied thereto to the necessary voltage for powering the lighting device 40, 42. The necessary power requirements for the flat lamp used in lighting device 40 is 250–280 volts of AC power at a frequency of 650 Hz. The light source 62 that is used is a fluorescent tube having standard power requirements as known in the art.

Power may be supplied to control box 72 via external power lines 76, which receive power from an external source, such as an underground power cable used to supply other electrical equipment, such as street lighting systems. Alternatively, power may be supplied by an energy storage device 78, such as a battery pack, charged by a solar energy converter 80 such as solar cells or photovoltaic panels positioned along any desired walls of receptacle 10 (FIG. 1). As shown in FIG. 1, solar panels 80 may be provided along top wall 20 (preferably along peripheral panels 22*a*) and/or the top of optional awning 26. Any desired solar cells or photovoltaic panels may be used as long as they can supply the requisite power for lighting devices 40, 42. Preferably, indestructible solar modules supplied by Sun Wize Specialty Product, Inc., a division of Besicorp Group Inc. of Kingston, N.Y. are used which may be supplied in any desired shape to cover the desired surface area of a desired wall of receptacle 10. The solar modules are selected to be capable of converting direct sunlight into the desired energy form necessary to power lighting device 40, 42.

Energy storage device 98 is provided to store energy generated by the solar energy converter 80 during daylight hours (when illumination of side walls 14 is unnecessary) for use during evening hours when illuminated of advertising panel 30 is desired. Preferably, the battery pack that is used is capable of providing the requisite power to lighting devices 40, 42 for approximately 84 continuous hours (e.g., to illuminate receptacle 10 for 12 hours per day, 7 days per week). Such a battery pack may be obtained from E-Lite Technologies, Inc., the same company that provides the electroluminescent flat lamp 50, in the form of aluminum-air cells consisting of an aluminum alloy anode between two air-breathing cathodes. On activation, alkali electrolyte is circulated through the system. Energy storage device 82 preferably is charged by solar energy converter 80 in a manner known in the art. However, if sufficient sunlight is not available to the solar modules (e.g., because of weather conditions, the time of the year, and latitude), the battery packs may not be charged sufficiently by solar energy converter 80, and are recharged independent of the solar modules, such as by replacing the cathodes and the electrolyte.

Figure 5:
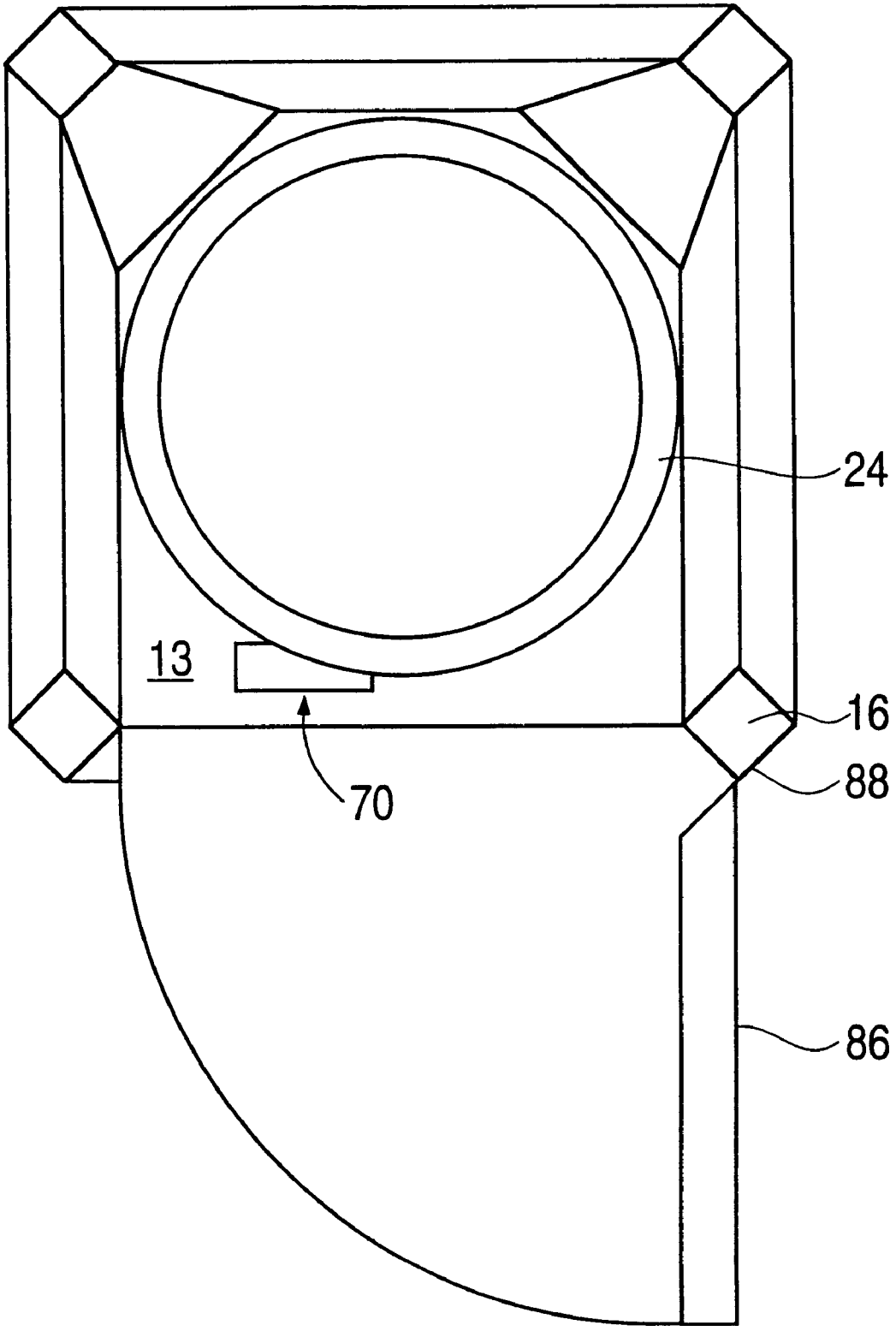
FIG. 5 is a top, plan view of a trash receptacle formed in accordance with the principles of the present invention and having a side-opening door.

The necessary power equipment 70 for supplying power to lighting devices 40, 42 is stored in interior space 13 within frame 12, and thus is accessible from the open upper end of frame 12. As will be appreciated from FIGS. 3 and 4, inner receptacle 24 must be removed before the power equipment is accessible. Preferably, a safety wall 84, which may be locked, is provided to restrict access to power equipment 70. Most preferably, the power equipment 70 is contained in an industry approved, weather-proof, tamper-proof, water-resistant power box. If desired, one of side walls 14 may be formed as a door 86, hinged to post 16 via hinge 88 (FIG. 5). Thus, access to power equipment 70 may be simplified such that reaching down into the interior of receptacle 12 from the top is unnecessary because side access is possible.

In accordance with the principles of the present invention, an illuminating mechanism that requires lower power than prior art lighting devices is provided in the side walls of a trash receptacle. Additionally, the illuminating mechanism provided by the present invention not only provides uniform illumination, but also may be formed to conform to the exact dimensions of the visible advertising area of the advertisement contained in the advertising panel of the side walls of the trash receptacle. Moreover, the illuminating element of the mechanisms provided by the present invention are thinner than prior art lighting devices, and typically are not much thicker than the advertisement itself. Accordingly, uniform illumination of an advertising panel of a trash receptacle may now be achieved with a lighting mechanism that may abut the entire surface area the advertisement without requiring much more space than required to house the advertisement.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A trash receptacle comprising:

at least one side wall;

an advertising panel in said side wall, said advertising panel being shaped to accommodate an advertisement and having a length and width defining a viewing area through which an advertisement is displayed and viewed; and a flat lighting device with a light-emitting surface having a length and width substantially the same as the length and width of said viewing area, said lighting device providing uniform light over said viewing area to thereby provide uniform illumination for an advertisement positioned therein.

2. A trash receptacle as in claim 1, wherein said light emitting surface is in the form of a substantially flat panel.

3. A trash receptacle as in claim 1, wherein said side wall has a recess formed therein and an upper open end, said lighting device having a light emitting surface slidable into and out of said recess of said side wall through said upper open end of said side wall.

4. A trash receptacle as in claim 3, wherein:

said lighting device comprises a flat lamp having an integral connector through which power is supplied to illuminate said light emitting surface;

said receptacle further comprises an electrical connector; and said integral connector of said lighting device and said electrical connector are frictionally connected to transmit power from said electrical connector to said integral connector.

5. A trash receptacle as in claim 1, wherein said lighting device is a flat panel lamp.

6. A trash receptacle as in claim 5, wherein said flat panel lamp is an electroluminescent lamp.

7. A trash receptacle as in claim 6, wherein said electroluminescent lamp comprises a pair of conductive layers and a phosphor layer between said conductive layers, said phosphor layer being excitable by the passage of electrical power through said conductive layers to cause said phosphor layer to luminesce.

8. A trash receptacle as in claim 7, wherein said electroluminescent lamp further comprises an integral connector tab for coupling to an electrical connector such that electrical power may be transmitted to said conductive layers.

9. A trash receptacle as in claim 6, further comprising an advertisement formed from a material illuminated by back lighting, said electroluminescent lamp being positioned behind said advertisement.

10. A trash receptacle as in claim 9, further comprising a clear protective panel, said advertisement being positioned between said clear protective panel and said electroluminescent lamp.

11. A trash receptacle as in claim 1, wherein said lighting device comprises a sheet of acrylic having a light-receiving end, said light emitting surface being formed at an angle with respect to said light-receiving end.

12. A trash receptacle as in claim 11, further comprising an advertisement formed from an opaque material and having an advertising surface, said light-receiving end of said lighting device being substantially perpendicular to said advertising surface and said light emitting surface being positioned over said advertising surface.

13. A trash receptacle as in claim 11, further comprising a light source positioned adjacent said light-receiving end of said lighting device.

14. A trash receptacle as in claim 1, further comprising an advertisement positioned within said advertising panel, said advertisement having an advertising surface corresponding to said viewing area, said light emitting surface of said lighting device directly contacting said advertising surface.

15. A trash receptacle as in claim 1, further comprising an advertisement recess for accommodating an advertisement and a recess for accommodating said lighting device and having substantially the same dimensions as said advertisement recess.

16. A trash receptacle as in claim 15, wherein said lighting device has a thickness of less than one centimeter.

17. A trash receptacle as in claim 16, wherein said lighting device has a thickness of approximately 10–15 mils.

18. A trash receptacle as in claim 1, further comprising a solar energy converter and an energy storage device for supply power to said flat lighting device.

* * * * *